US012624433B2

(12) United States Patent
Fujimura et al.

(10) Patent No.: US 12,624,433 B2
(45) Date of Patent: May 12, 2026

(54) FERRITIC STAINLESS STEEL AND METHOD FOR MANUFACTURING SAME

(71) Applicant: Nippon Steel Stainless Steel Corporation, Tokyo (JP)

(72) Inventors: Yoshitomo Fujimura, Tokyo (JP); Takahito Hamada, Tokyo (JP); Taichiro Mizoguchi, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 690 days.

(21) Appl. No.: 17/802,613

(22) PCT Filed: Mar. 4, 2021

(86) PCT No.: PCT/JP2021/008317
§ 371 (c)(1),
(2) Date: Aug. 26, 2022

(87) PCT Pub. No.: WO2021/182266
PCT Pub. Date: Sep. 16, 2021

(65) Prior Publication Data

US 2023/0105051 A1 Apr. 6, 2023

(30) Foreign Application Priority Data

Mar. 12, 2020 (JP) ..... 2020-043212

(51) Int. Cl.
*C22C 38/50* (2006.01)
*C21D 8/0221* (2026.01)
(Continued)

(52) U.S. Cl.
CPC ..... *C22C 38/50* (2013.01); *C21D 8/0226* (2013.01); *C21D 8/0236* (2013.01);
(Continued)

(58) Field of Classification Search
CPC ..... H01M 8/021; H01M 8/0228; H01M 2008/1095; H01M 8/10; C22C 38/004;
(Continued)

(56) References Cited

U.S. PATENT DOCUMENTS 11,085,120 B2 * 8/2021 Yano ..... H01M 8/021
2014/0154129 A1 6/2014 Makiishi et al.
(Continued)

FOREIGN PATENT DOCUMENTS

CN 1220706 A 6/1999
CN 103717769 A 4/2014
(Continued)

OTHER PUBLICATIONS

International Search Report for Application No. PCT/JP2021/008317, dated May 18, 2021, 5 pages.
(Continued)

*Primary Examiner* — Jie Yang
(74) *Attorney, Agent, or Firm* — McCarter & English, LLP; Dave S. Christensen

(57) ABSTRACT

Realized is ferritic stainless steel which has excellent high-temperature strength and excellent red scale resistance. The ferritic stainless steel contains not more than 0.025% by mass of C, 0.05% by mass to 3.0% by mass of Si, 0.05% by mass to 2.0% by mass of Mn, not more than 0.04% by mass of P, not more than 0.03% by mass of S, not more than 0.5% by mass of Ni, 10.5% by mass to 25.0% by mass of Cr, not more than 0.025% by mass of N, 0.05% by mass to 1.0% by mass of Nb, not more than 3.0% by mass of Mo, not more than 1.8% by mass of Cu, not more than 0.2% by mass of Al, and not more than 0.5% by mass of Ti. The sum of the concentrations of Cr and Si, each of which is present as
(Continued)

oxide or hydroxide, at a surface of the ferritic stainless steel and at depths to 6 nm from the surface is a given value or more.

3 Claims, 4 Drawing Sheets

(51) Int. Cl.

| | |
|---|---|
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C23G 1/08*** | (2006.01) |

(52) U.S. Cl.
CPC ..... *C21D 8/0273* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C23G 1/085* (2013.01); *C21D 2211/005* (2013.01)

(58) Field of Classification Search
CPC ..... C22C 38/04; C22C 38/02; C22C 38/18; C22C 38/48; C22C 38/50; C22C 38/00; C21D 6/002; C21D 6/004
See application file for complete search history.

(56) References Cited

U.S. PATENT DOCUMENTS

| | | | |
|---|---|---|---|
| 2014/0373980 | A1 | 12/2014 | Hayashi et al. |
| 2020/0227760 | A1 | 7/2020 | Yano et al. |
| 2020/0340126 | A1 | 10/2020 | Yano et al. |

FOREIGN PATENT DOCUMENTS

| | | | |
|---|---|---|---|
| CN | 104105809 | A | 10/2014 |
| CN | 105074035 | A | 11/2015 |
| JP | 858-185780 | A | 10/1983 |
| JP | H02-054789 | A | 2/1990 |
| JP | H11-050202 | A | 2/1999 |
| JP | 2002-256472 | A | 9/2002 |
| JP | 2003-119551 | A | 4/2003 |
| JP | 2003-160842 | A | 6/2003 |
| JP | 2003-160844 | A | 6/2003 |
| JP | 3598981 | B2 | 12/2004 |
| JP | 2012-112025 | A | 6/2012 |
| JP | 2013-227659 | A | 11/2013 |
| JP | 5684547 | B2 | 3/2015 |
| JP | 2019-073783 | A | 5/2019 |
| JP | 2019-173073 | A | 10/2019 |
| WO | 2014/001644 | A1 | 1/2014 |
| WO | 2014/157341 | A1 | 10/2014 |
| WO | 2018/147087 | A1 | 8/2018 |
| WO | 2018/198685 | A1 | 11/2018 |

OTHER PUBLICATIONS

International Preliminary Report on Patentability for Application No. PCT/JP2021/008317, dated Jan. 7, 2022, 8 pages.

* cited by examiner

FERRITIC STAINLESS STEEL AND METHOD FOR MANUFACTURING SAME

CROSS-REFERENCE TO RELATED APPLICATIONS

This application is a 35 U.S.C. § 371 national stage filing of International Application No. PCT/JP2021/008317, filed on Mar. 4, 2021, which claims priority to Japanese Patent Application No. 2020-043212, filed on Mar. 12, 2020. The entire contents of each of the aforementioned applications are incorporated herein by reference.

TECHNICAL FIELD

The present invention relates to ferritic stainless steel. More specifically, the present invention relates to ferritic stainless steel which has excellent red scale resistance and excellent high-temperature strength in a high-temperature water-vapor atmosphere, and also relates to a method for manufacturing the ferritic stainless steel.

BACKGROUND ART

In a case where stainless steel is used in applications such as an exhaust gas passage member, a stove burning appliance, a member for a fuel cell, or a plant-related material, the stainless steel is usually heated to a temperature as high as 300° C. to 900° C. In the above applications, since the stainless steel is used in an environment which contains water vapor, red scales (Fe-based oxide) may be generated.

Therefore, in a high-temperature water-vapor atmosphere, ferritic stainless steel which has red scale resistance and high-temperature strength is desired. Conventionally, there have been known various methods for enhancing the red scale resistance and the high-temperature strength.

Patent Literatures 1 and 2 disclose adding Si so as to promote diffusion of Cr, thereby increasing the amount of Cr-based oxide to be generated and strengthening an oxide film. In this manner, the inventions disclosed in Patent Literatures 1 and 2 have enhanced water vapor oxidation resistance and enhanced red scale resistance.

CITATION LIST

Patent Literature

[Patent Literature 1]
Japanese Patent Application Publication Tokukai No. 2003-160844
[Patent Literature 2]
Japanese Patent Application Publication Tokukai No. 2003-160842

SUMMARY OF INVENTION

Technical Problem

A conventional technique as described above focuses on Cr and Si contained in steel, and is for optimizing the amount of Cr and Si contained in the steel. The inventors of the present invention focused on the point that the concentrations of oxide and hydroxide of Cr and oxide of Si in a passive film are important to enhance red scale resistance and high-temperature strength. However, in the conventional technique, no findings were obtained on the concentrations of Cr-based oxide and Si-based oxide in the passive film.

An object of an aspect of the present invention is to realize ferritic stainless steel which has excellent high-temperature strength and excellent red scale resistance.

Solution to Problem

In order to attain the above object, ferritic stainless steel in accordance with an aspect of the present invention is ferritic stainless steel containing not more than 0.025% by mass of C, not less than 0.05% by mass and not more than 3.0% by mass of Si, not less than 0.05% by mass and not more than 2.0% by mass of Mn, not more than 0.04% by mass of P, not more than 0.03% by mass of S, not more than 0.5% by mass of Ni, not less than 10.5% by mass and not more than 25.0% by mass of Cr, not more than 0.025% by mass of N, not less than 0.05% by mass and not more than 1.0% by mass of Nb, not more than 3.0% by mass of Mo, not more than 1.8% by mass of Cu, not more than 0.2% by mass of Al, and not more than 0.5% by mass of Ti and containing iron and an inevitable impurity as a remainder, when spectra are measured, by XPS analysis, at a surface of the ferritic stainless steel and at depths of from 0.5 nm to 6 nm from the surface in increments of 0.5 nm, the ferritic stainless steel satisfying the following Expression (1):

$$Cr(O)+Si(O)\geq 240 \quad \ldots \quad (1)$$

where (i) Cr(O) represents a value obtained by calculating, for each measurement depth in terms of an atomic percent concentration with use of each of the spectra, a proportion of the total number of atoms of Cr which is present as oxide or hydroxide to the total number of atoms of Fe, Cr, Ti, Nb, Mo, and Si each of which is present as a simple substance, oxide, or hydroxide and integrating all calculated atomic percent concentrations, and (ii) Si(O) represents a value obtained by calculating, for each measurement depth in terms of an atomic percent concentration with use of each of the spectra, a proportion of the number of atoms of Si which is present as oxide to the total number of atoms of Fe, Cr, Ti, Nb, Mo, and Si each of which is present as a simple substance, oxide, or hydroxide and integrating all calculated atomic percent concentrations.

A method for manufacturing ferritic stainless steel in accordance with an aspect of the present invention is a method for manufacturing ferritic stainless steel which contains not more than 0.025% by mass of C, not less than 0.05% by mass and not more than 3.0% by mass of Si, not less than 0.05% by mass and not more than 2.0% by mass of Mn, not more than 0.04% by mass of P, not more than 0.03% by mass of S, not more than 0.5% by mass of Ni, not less than 10.5% by mass and not more than 25.0% by mass of Cr, not more than 0.025% by mass of N, not less than 0.05% by mass and not more than 1.0% by mass of Nb, not more than 3.0% by mass of Mo, not more than 1.8% by mass of Cu, not more than 0.2% by mass of Al, and not more than 0.5% by mass of Ti and which contains iron and an inevitable impurity as a remainder, the method including a surface activation treatment step of immersing a steel strip, which has been subjected to a descaling treatment, in 80 g/L to 120 g/L of a nitric acid solution at not lower than 50° C. and not higher than 70° C. for not shorter than 60 seconds and not longer than 120 seconds.

Advantageous Effects of Invention

According to an aspect of the present invention, it is possible to realize ferritic stainless steel which has excellent high-temperature strength and excellent red scale resistance.

DESCRIPTION OF EMBODIMENTS

Figure 1:
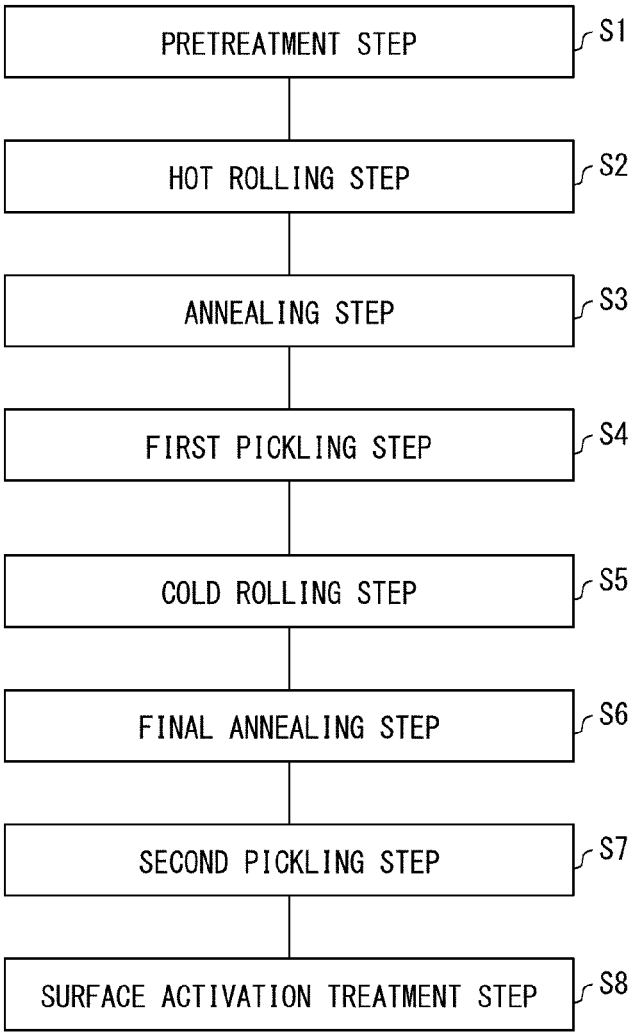
FIG. 1 is a flowchart illustrating an example of a method for manufacturing ferritic stainless steel in accordance with an embodiment of the present invention.

The following description will discuss embodiments of the present invention. Note that the following description is intended to make the gist of the present invention understood better, and does not limit the present invention unless otherwise specified. Note also that, in the present application, the expression "A to B" indicates not less than A and not more than B.

In this specification, the term "stainless steel" means a stainless steel material the shape of which is not specifically limited. Example of the stainless steel material includes steel sheets, steel pipes, and steel bars.

<Component Composition of Ferritic Stainless Steel>

Ferritic stainless steel in accordance with an embodiment of the present invention contains components described below in amounts described below. Note that the ferritic stainless steel contains, in addition to the components described below, iron (Fe) or a small amount of an impurity which is inevitably contained (inevitable impurity).

(Chromium: Cr)

Cr is an essential element to form a passive film and ensure corrosion resistance. Cr is also useful in ensuring red scale resistance. However, an excessive amount of Cr causes an increase in material costs and a decrease in toughness. Therefore, the ferritic stainless steel in accordance with an aspect of the present invention contains Cr in an amount of 10.5% by mass to 25% by mass, and preferably 12.5% by mass to 23% by mass.

(Silicon: Si)

Silicon is a useful element in improving the red scale resistance. However, an excessive amount of Si causes a decrease in toughness and a decrease in processability. Therefore, the ferritic stainless steel in accordance with an aspect of the present invention contains Si in an amount of 0.05% by mass to 3.0% by mass, and preferably 0.1% by mass to 2.6% by mass.

(Copper: Cu)

Cu is an element which is added to ensure high-temperature strength. However, an excessive amount of Cu causes destabilization of a ferrite phase and an increase in material costs. Therefore, the ferritic stainless steel in accordance with an aspect of the present invention contains Cu in an amount of 0% by mass to 1.8% by mass.

(Molybdenum: Mo)

Mo is an element which is added to ensure the high-temperature strength. However, an excessive amount of Mo causes hardening of the ferritic stainless steel, thereby causing a decrease in processability and an increase in material costs. Therefore, the ferritic stainless steel in accordance with an aspect of the present invention contains Mo in an amount of 0% by mass to 3.0% by mass.

(Niobium: Nb)

Nb is an element which is added to ensure the high-temperature strength. However, an excessive amount of Nb possibly causes a deterioration in processability and a deterioration in toughness. Therefore, the ferritic stainless steel in accordance with an aspect of the present invention contains Nb in an amount of 0.05% by mass to 1.0% by mass, and preferably 0.05% by mass to 0.7% by mass.

(Titanium: Ti)

Ti is an element which, by reacting with C and/or N, can form the ferritic stainless steel into a ferritic single layer at 900° C. to 1000° C. and which enhances the red scale resistance and the processability. However, an excessive amount of Ti possibly causes a deterioration in processability and a deterioration in surface quality. Therefore, the ferritic stainless steel in accordance with an aspect of the present invention contains Ti in an amount of 0% by mass to 0.5% by mass.

(Manganese: Mn)

Mn is an element which, in the ferritic stainless steel, enhances the adhesiveness of scales. However, an excessive amount of Mn causes destabilization of the ferrite phase and promotes generation of MnS which is a corrosion-initiated point. Therefore, the ferritic stainless steel in accordance with an aspect of the present invention contains Mn in an amount of 0.05% by mass to 2.0% by mass, and preferably 0.10% by mass to 1.20% by mass.

(Carbon: C)

An excessive amount of C causes an increase in carbide content and a decrease in corrosion resistance. Therefore, the ferritic stainless steel in accordance with an aspect of the present invention contains C in an amount of 0% by mass to 0.025% by mass, and preferably 0% by mass to 0.020% by mass.

(Phosphorus: P)

An excessive amount of P causes a decrease in processability. Therefore, the ferritic stainless steel in accordance with an aspect of the present invention contains P in an amount of 0% by mass to 0.04% by mass.

(Sulfur: S)

An excessive amount of S promotes generation of a corrosion-initiated point in the ferritic stainless steel. Therefore, the ferritic stainless steel in accordance with an aspect of the present invention contains S in an amount of 0% by mass to 0.03% by mass.

(Nickel: Ni)

Ni is an element which enhances the corrosion resistance of the ferritic stainless steel. However, an excessive amount of Ni causes destabilization of the ferrite phase and an increase in material costs. Therefore, the ferritic stainless steel in accordance with an aspect of the present invention contains Ni in an amount of 0% by mass to 0.5% by mass.

(Nitrogen: N)

An excessive amount of N forms a nitride together with another element and causes hardening of the ferritic stainless steel. Therefore, the ferritic stainless steel in accordance with an aspect of the present invention contains N in an amount of 0% by mass to 0.025% by mass.

(Aluminum: Al)

Al is an element which enhances the corrosion resistance of the ferritic stainless steel. Further, Al is a useful element as a deoxidizer used during steel making. However, an excessive amount of Al possibly causes a deterioration in surface quality. Therefore, the ferritic stainless steel in accordance with an aspect of the present invention contains Al in an amount of 0% by mass to 0.2% by mass, and preferably 0% by mass to 0.1% by mass.

<Other Components>

The ferritic stainless steel in accordance with an embodiment of the present invention may contain one or more of 0% by mass to 2.5% by mass of W, 0% by mass to 0.1% by mass of La, 0% by mass to 0.05% by mass of Ce, not more than 0.01% by mass of B, not less than 0.0002% by mass and not more than 0.0030% by mass of Ca, not less than 0.001% by mass and not more than 0.5% by mass of Hf, not less than 0.01% by mass and not more than 0.40% by mass of Zr, not less than 0.005% by mass and not more than 0.50% by mass of Sb, not less than 0.01% by mass and not more than 0.30% by mass of Co, not less than 0.001% by mass and not more than 1.0% by mass of Ta, not less than 0.002% by mass and not more than 1.0% by mass of Sn, not less than 0.0002% by mass and not more than 0.30% by mass of Ga, not less than 0.001% by mass and not more than 0.20% by mass of a rare earth element, and not less than 0.0003% by mass and not more than 0.0030% by mass of Mg.

(Tungsten: W)

W is an element which is added to ensure the high-temperature strength. However, an excessive amount of W causes an increase in material costs. Therefore, 0% by mass to 2.5% by mass of W may be added, as necessary, to the ferritic stainless steel in accordance with an aspect of the present invention. In consideration of the costs, the ferritic stainless steel contains W in an amount of preferably 0.01% by mass to 1.5% by mass.

(Lanthanum: La)

La is an element which is added to enhance the red scale resistance and scale peeling resistance. However, an excessive amount of La causes an increase in material costs. Therefore, 0% by mass to 0.1% by mass of La may be added, as necessary, to the ferritic stainless steel in accordance with an aspect of the present invention. In consideration of the costs, the ferritic stainless steel contains La in an amount of preferably 0% by mass to 0.05% by mass.

(Cerium: Ce)

Ce is an element which is added to enhance the red scale resistance and the scale peeling resistance. However, an excessive amount of Ce causes an increase in material costs. Therefore, 0% by mass to 0.05% by mass of Ce may be added, as necessary, to the ferritic stainless steel in accordance with an aspect of the present invention.

(Boron: B)

B is an element which enhances secondary processability of a molded product manufactured with use of the ferritic stainless steel. However, an excessive amount of B is likely to cause formation of a compound such as $Cr_2B$, and possibly causes a deterioration in red scale resistance. Therefore, not more than 0.01% by mass of B may be added, as necessary, to the ferritic stainless steel in accordance with an aspect of the present invention. Preferably, not less than 0.0002% by mass and not more than 0.003% by mass of B may be added to the ferritic stainless steel in accordance with an aspect of the present invention.

(Calcium: Ca)

Ca is an element which promotes high-temperature oxidation resistance. To the ferritic stainless steel in accordance with an embodiment of the present invention, not less than 0.0002% by mass of Ca may be added, as necessary. However, addition of an excessive amount of Ca causes a decrease in corrosion resistance. Therefore, the upper limit of the amount of Ca to be added is preferably 0.0030% by mass.

(Zirconium: Zr)

Zr is an element which enhances the high-temperature strength, the corrosion resistance, and the high-temperature oxidation resistance. Not less than 0.01% by mass of Zr may be added, as necessary, to the ferritic stainless steel in accordance with an embodiment of the present invention. However, addition of an excessive amount of Zr causes a decrease in processability and a decrease in manufacturability. Therefore, the upper limit of the amount of Zr to be added is preferably 0.40% by mass.

(Hafnium: Hf)

Hf is an element which enhances the corrosion resistance, the high-temperature strength, and oxidation resistance. Not less than 0.001% by mass of Hf may be added, as necessary, to the ferritic stainless steel in accordance with an embodiment of the present invention. However, addition of an excessive amount of Hf possibly causes a decrease in processability and a decrease in manufacturability. Therefore, the upper limit of the amount of Hf to be added is preferably 0.5% by mass.

(Tin: Sn)

Sn is an element which enhances the corrosion resistance and the high-temperature strength. Not less than 0.002% by mass of Sn may be added, as necessary, to the ferritic stainless steel in accordance with an embodiment of the present invention. However, addition of an excessive amount of Sn possibly causes a decrease in toughness and a decrease in manufacturability. Therefore, the upper limit of the amount of Sn to be added is preferably 1.0% by mass.

(Magnesium: Mg)

Mg is an element which causes the structure of a slab to be fine and enhances moldability, in addition to being a deoxidizing element. Not less than 0.0003% by mass of Mg may be added, as necessary, to the ferritic stainless steel in accordance with an embodiment of the present invention. However, addition of an excessive amount of Mg causes a decrease in corrosion resistance, a decrease in weldability, and a decrease in surface quality. Therefore, the upper limit of the amount of Mg to be added is preferably 0.0030% by mass.

(Cobalt: Co)

Co is an element which enhances the high-temperature strength. Not less than 0.01% by mass of Co may be added, as necessary, to the ferritic stainless steel in accordance with an embodiment of the present invention. However, addition of an excessive amount of Co causes a decrease in toughness and a decrease in manufacturability. Therefore, the upper limit of the amount of Co to be added is preferably 0.30% by mass.

(Antimony: Sb)

Sb is an element which enhances the high-temperature strength. Not less than 0.005% by mass of Sb may be added, as necessary, to the ferritic stainless steel in accordance with an embodiment of the present invention. However, addition of an excessive amount of Sb causes a decrease in weldability and a decrease in toughness. Therefore, the upper limit of the amount of Sb to be added is preferably 0.50% by mass.

(Tantalum: Ta)

Ta is an element which enhances the high-temperature strength. Not less than 0.001% by mass of Ta may be added, as necessary, to the ferritic stainless steel in accordance with an embodiment of the present invention. However, addition of an excessive amount of Ta causes a decrease in weldability and a decrease in toughness. Therefore, the upper limit of the amount of Ta to be added is preferably 1.0% by mass.

(Gallium: Ga)

Ga is an element which enhances the corrosion resistance and hydrogen embrittlement resistance. Not less than 0.0002% by mass of Ga may be added, as necessary, to the ferritic stainless steel in accordance with an embodiment of the present invention. However, addition of an excessive amount of Ga causes a decrease in weldability and a decrease in toughness. Therefore, the upper limit of the amount of Ga to be added is preferably 0.30% by mass.

(Rare Earth Elements: REM)

REM is a generic name of scandium (Sc), yttrium (Y), and 15 elements (lanthanoids) from lanthanum (La) to lutetium (Lu). REM may be added as a single element or may be added as a mixture of a plurality of elements. REM is an element which enhances the cleanliness of the stainless steel and also improves the high-temperature oxidation resistance. Not less than 0.001% by mass of REM may be added, as necessary, to the ferritic stainless steel in accordance with an embodiment of the present invention. However, addition of an excessive amount of REM causes an increase in alloy costs and a decrease in manufacturability. Therefore, the upper limit of the amount of REM to be added is preferably 0.20% by mass.

<Cr(O) and Si(O) in Passive Film>

The significance of the amount of each element contained in the ferritic stainless steel in accordance with an aspect of the present invention has been described. The ferritic stainless steel in accordance with an aspect of the present invention has excellent high-temperature strength and excellent red scale resistance, because Cr(O) and Si(O), which are defined below, in the passive film satisfy Expression (1) below. More specifically, since Cr(O) and Si(O) satisfy Expression (1) below, the ferritic stainless steel which has excellent high-temperature strength and excellent red scale resistance in an environment that is at 300° C. to 900° C. and that contains water vapor can be provided. Note that oxide of Si in the passive film includes oxide of Si which is contained in the passive film and oxide (e.g., silicon monoxide) of Si which is present on a surface of the passive film.

$$Cr(O)+Si(O)\geq 240 \ldots \quad (1)$$

Figure 5:
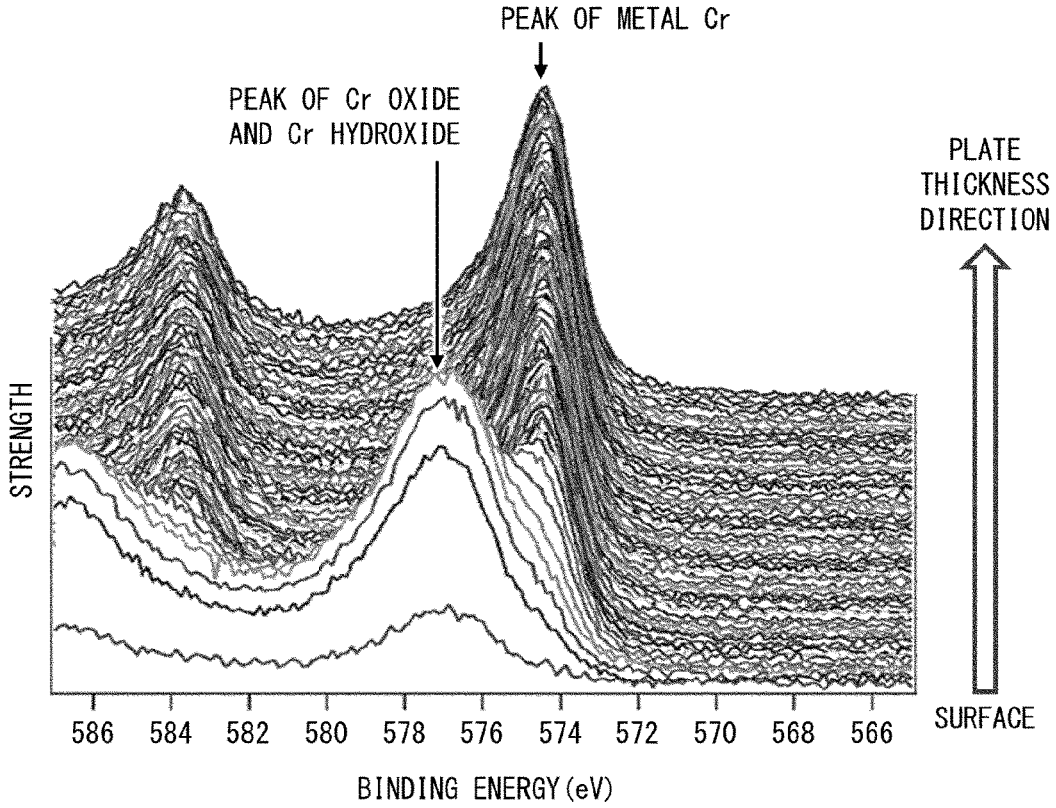
FIG. 5 shows an example of spectra obtained by carrying out measurement by XPS with respect to ferritic stainless steel in accordance with an embodiment of the present invention, and is a graph showing changes of Cr 2p spectra in the depth direction.
Figure 6:
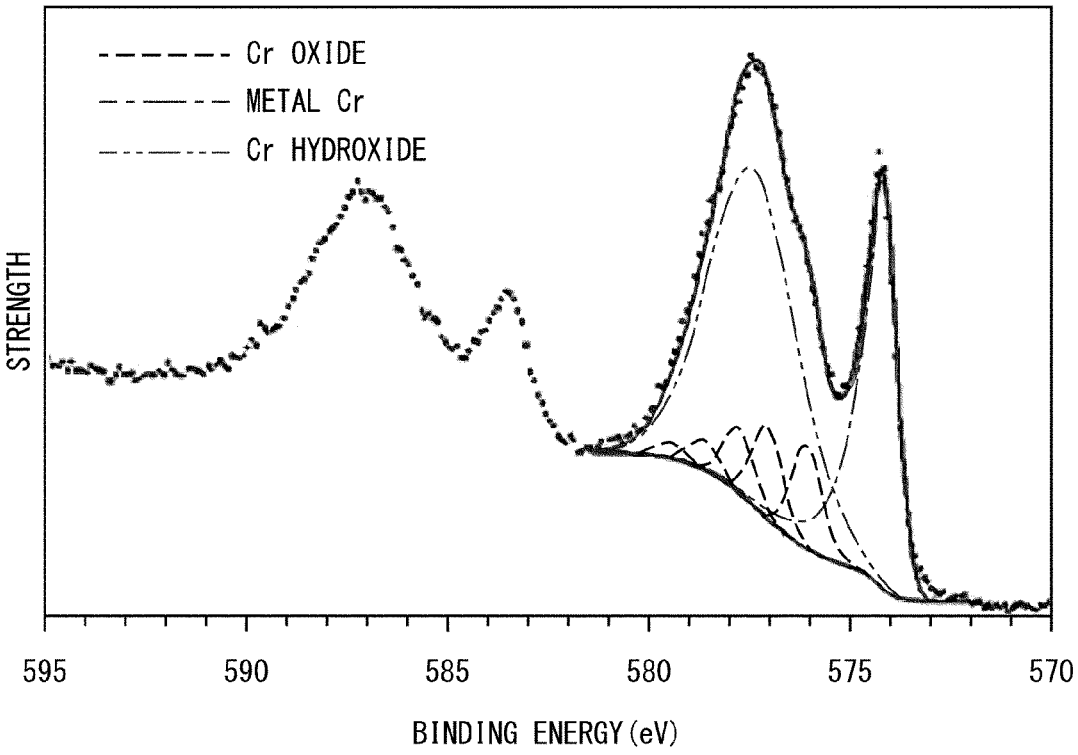
FIG. 6 shows an example of spectra obtained by carrying out measurement by XPS with respect to the ferritic stainless steel in accordance with an embodiment of the present invention, and is a graph showing a result of carrying out peak separation with respect to the Cr 2p spectra to obtain separated peaks corresponding to metal Cr, oxide of Cr, and hydroxide of Cr.

With reference to FIGS. 5 and 6, Cr(O) and Si(O) are described below. FIG. 5 shows an example of spectra obtained by carrying out measurement with use of an X-ray photoelectron spectroscopy (XPS) analyzer with respect to the ferritic stainless steel in accordance with an embodiment of the present invention, and is a graph showing changes of Cr 2p spectra in the depth direction. FIG. 6 shows an example of spectra obtained by carrying out measurement by XPS with respect to the ferritic stainless steel in accordance with an embodiment of the present invention, and is a graph showing a result of carrying out peak separation with respect to the Cr 2p spectra to obtain separated peaks corresponding to metal Cr, oxide of Cr, and hydroxide of Cr.

First, narrow spectra of each of Fe, Cr, Ti, Nb, Mo and Si (six types of metals) are measured, with use of the XPS analyzer, at a surface of the ferritic stainless steel and at depths of from 0.5 nm to 6 nm from the surface in increments of 0.5 nm. In FIG. 5, the narrow spectra of Cr are shown as an example. As shown in FIG. 5, the spectra of Cr have a peak corresponding to Cr oxide and Cr hydroxide and a peak corresponding to metal Cr.

Next, peak separation is carried out with respect to the obtained narrow spectra of each of the six types of metals to obtain separated peaks corresponding to a simple substance, oxide, and hydroxide each of which is derived from atoms of the each of the six types of metals. FIG. 6 shows, as an example, a result of carrying out the peak separation with respect to the narrow spectra of Cr. Next, the proportions of (i) Cr which is present as metal Cr (simple substance), (ii) Cr which is present as oxide of Cr, and (iii) Cr which is present as hydroxide of Cr are respectively calculated from the areas of the peaks. Similarly, in regard to each of the other types of metals, the proportions of (i) atoms which are present as a simple substance, (ii) atoms which are present as oxide, and (ii) atoms which are present as hydroxide are calculated.

Subsequently, by using the proportion of Fe, Cr, Ti, Nb, Mo, and Si (six types of metals) and the proportion of each matter state of each of these elements, it is possible to calculate, for each measurement depth, the atomic percent concentration of each matter state (simple substance, oxide, or hydroxide) of each of the six types of metals when the total number of atoms of the six types of metals each of which is present as a simple substance, oxide, or hydroxide is regarded as 100% by atom.

Note, here, that Cr(O) is a value obtained by integrating the atomic percent concentrations of the oxide and the hydroxide of Cr. That is, Cr(O) represents a value obtained by (i) measuring the spectra by XPS analysis at the surface and at the depths of from 0.5 nm to 6 nm from the surface in increments of 0.5 nm, (ii) calculating, for each measurement depth in terms of an atomic percent concentration with use of each of the spectra, the proportion of the total number of atoms of Cr which is present as oxide or hydroxide to the total number of atoms of Fe, Cr, Ti, Nb, Mo, and Si each of which is present as a simple substance, oxide, or hydroxide, and (iii) integrating all calculated atomic percent concentrations.

Si(O) is a value obtained by integrating the atomic percent concentrations of the oxide of Si. That is, Si(O) represents a value obtained by (i) measuring the spectra in a similar manner, (ii) calculating, for each measurement depth in terms of an atomic percent concentration with use of each of the spectra, the proportion of the number of atoms of Si which is present as oxide to the total number of atoms of Fe, Cr, Ti, Nb, Mo, and Si each of which is present as a simple substance, oxide, or hydroxide, and (iii) integrating all calculated atomic percent concentrations.

In the present embodiment, the oxide of Cr (Cr which is present as oxide) includes one or more of chromium(III) oxide ($Cr_2O_3$), chromium(IV) oxide ($CrO_2$), and chromium (VI) oxide ($CrO_3$). The hydroxide of Cr (Cr which is present as hydroxide) includes one or more of chromium(II) hydroxide ($Cr(OH)_2$) and chromium(III) hydroxide ($Cr(OH)_3$). The oxide of Si (Si which is present as oxide) includes one or more of silicon dioxide ($SiO_2$) and silicon monoxide (SiO).

Note that the XPS analyzer used in the foregoing XPS measurement and conditions under which the measurement is carried out are as follows.

Analyzer: Quantera SXM, manufactured by ULVAC-PHI, Inc.

X-ray source: mono-A1K α-ray (hv=1486.6 eV) Detection depth: several nanometers (take-off angle of 45°)

X-ray diameter: 200 μmφ

Neutralization gun: 1.0 V, 20 μA

Sputtering conditions: $Ar^+$, acceleration voltage: 1 kV, raster: 2×2 mm

Sputtering rate: 1.3 nm/min (value based on $SiO_2$ conversion)

The inventors of the present invention focused on Cr and Si in a passive film, and found that, in a case where the sum of Cr(O) and Si(O) in the passive film satisfies the above Expression (1), ferritic stainless steel which has excellent red scale resistance and excellent high-temperature strength can be realized.

Conventionally, as a method for enhancing the red scale resistance, a method which involves polishing a surface of steel as a finishing process so as to promote diffusion of Cr in the steel and promote generation of oxide of Cr, a method which involves forming a hot-dip plating layer on a surface layer, or the like has been used.

The inventors of the present invention found that, for example, by the following manufacturing method, ferritic stainless steel which satisfies the above Expression (1) and which has excellent red scale resistance and excellent high-temperature strength can be obtained.

<Manufacturing Method>

The ferritic stainless steel in accordance with an embodiment of the present invention is obtained, for example, as a ferritic stainless steel strip. FIG. 1 is a flowchart illustrating an example of a method for manufacturing the ferritic stainless steel in accordance with the present embodiment. As illustrated in FIG. 1, the method for manufacturing the ferritic stainless steel strip in accordance with the present embodiment includes a pretreatment step S1, a hot rolling step S2, an annealing step S3, a first pickling step S4, a cold rolling step S5, a final annealing step S6, a second pickling step S7, and a surface activation treatment step S8.

(Pretreatment Step)

In the pretreatment step S1, first, steel which has been adjusted so as to have composition falling within the scope of the present invention is melted with use of a melting furnace having a vacuum atmosphere or an argon atmosphere, and this steel is cast to manufacture a slab. Subsequently, the slab is cut to obtain a slab piece for hot rolling. Then, the slab piece is heated to a temperature range of 1100° C. to 1300° C. in an air atmosphere. A time for which the slab piece is heated and held is not limited. Note that, in a case where the pretreatment step is industrially carried out, the above casting may be continuous casting.

The hot rolling step S2 is a step of hot-rolling the slab (steel ingot), obtained in the pretreatment step S1, to manufacture a hot-rolled steel strip having a given thickness.

The annealing step S3 is a step of heating the hot-rolled steel strip, obtained in the hot rolling step S2, so as to soften the steel strip. This annealing step S3 is a step carried out as necessary, and may not be carried out.

The first pickling step S4 is a step of washing off, with use of a pickle such as a mixed solution of hydrochloric acid or nitric acid and hydrofluoric acid, scales adhering to a surface of the steel strip.

The cold rolling step S5 is a step of rolling the steel strip from which the scales have been removed in the first pickling step S4, so as to make the steel strip thinner.

The final annealing step S6 is a step of heating the steel strip which has been thinly rolled in the cold rolling step S5, so as to remove a strain and soften the steel strip. Annealing in the final annealing step S6 is carried out, for example, at a temperature of approximately 900° C. to 1100° C., depending on alloy components.

The second pickling step S7 is a step of washing off, with use of a pickle such as a nitric acid solution or a mixed solution of nitric acid and hydrofluoric acid, scales adhering to the surface of the steel strip obtained in the final annealing step S6. The second pickling step S7 is not particularly limited, provided that the scales on the surface of the steel strip can be removed. For example, as the second pickling step S7, an electrolytic treatment may be carried out in which electrolysis is carried out under a condition of 0.2 $A/cm^2$ to 0.3 $A/cm^2$ for 1 to 2 minutes in a state where the steel strip is immersed in a nitric acid solution (concentration of nitric acid: 150 g/L) at 50° C. to 70° C. Alternatively, as the second pickling step S7, a treatment may be carried out in which the steel strip is immersed in a mixed solution of a nitric acid solution (concentration of nitric acid: 100 g/L) and hydrofluoric acid (15 g/L to 25 g/L) at 50° C. to 70° C. for 1 to 2 minutes.

The surface activation treatment step S8 is a step of concentrating Cr and Si in the passive film by immersing the steel strip which has been subjected to the second pickling step S7, in 80 g/L to 120 g/L of a nitric acid solution at not lower than 50° C. and not higher than 70° C. for not shorter than 60 seconds and not longer than 120 seconds. In this specification, a treatment carried out under the above conditions is referred to as a surface activation treatment. By carrying out the surface activation treatment, the ferritic stainless steel strip which satisfies the above Expression (1) can be obtained. Note that this surface activation treatment step S8 can be carried out with use of a device which is the same as or similar to that used in the second pickling step S7.

Note that the ferritic stainless steel in accordance with an embodiment of the present invention has excellent high-temperature strength and excellent red scale resistance because Cr(O) and Si(O) in the passive film satisfy the above Expression (1). The inventors of the present invention found that, by carrying out both of the second pickling step S7 and the surface activation treatment step S8, the ferritic stainless steel which satisfies the above Expression (1) can be obtained. For example, in a case where any one of the second pickling step S7 and the surface activation treatment step S8 is omitted, the ferritic stainless steel which satisfies the above Expression (1) cannot be obtained. That is, by carrying out the surface activation treatment with respect to the steel strip from which the scales have has been removed in the second pickling step S7, Cr and Si in the passive film are concentrated, so that the ferritic stainless steel in accordance with an embodiment of the present invention, which satisfies the above Expression (1), can be obtained.

In regard to the conditions used in the surface activation treatment step, in a case where the concentration of the nitric acid solution is less than 80 g/L, a surface activation effect brought about by nitric acid is lessened, and generation of red scales cannot be prevented. In a case where the concentration of the nitric acid solution exceeds 120 g/L, the surface activation effect peaks out due to an excessive reaction with nitric acid, and generation of red scales cannot be prevented. In a case where the nitric acid solution is at less than 50° C., the surface activation effect brought about by nitric acid is lessened, and generation of red scales cannot be prevented. In a case where the nitric acid solution exceeds 70° C., the surface activation effect peaks out due to an excessive reaction with nitric acid, and generation of red scales cannot be prevented. In a case where a time for which immersion is carried out is less than 60 seconds, the surface activation effect brought about by nitric acid becomes insufficient, and generation of red scales cannot be prevented. In a case where the time for which the immersion is carried out exceeds 120 seconds, the surface activation effect peaks out due to an excessive reaction with nitric acid, and generation of red scales cannot be prevented.

As has been described, in the conventional technique, a step such as polish finishing or formation of a plating layer is added as a finishing step for enhancing high-temperature strength and red scale resistance. However, such a finishing step has a problem that it is necessary to introduce a new device for the finishing step and therefore manufacturing costs are increased. From this viewpoint, it is also the object of the present invention to provide a method for manufacturing ferritic stainless steel which has excellent red scale resistance and excellent high-temperature strength, without causing an increase in manufacturing costs.

In the manufacturing method in accordance with an aspect of the present invention, after the descaling treatment (second pickling step), the surface activation treatment is carried out in which the steel strip is immersed in 80 g/L to 120 g/L of the nitric acid solution at not lower than 50° C. and not higher than 70° C. for not shorter than 60 seconds and not longer than 120 seconds. This makes it possible to realize ferritic stainless steel which has excellent high-temperature strength and excellent red scale resistance, without causing an increase in manufacturing costs.

EXAMPLES

First, components shown in Table 1 below were prepared as raw materials, and the steps up to the second pickling step S7 included in the foregoing manufacturing method were carried out to manufacture ferritic stainless steel. Note that, in manufacturing each steel material shown in Table 1, conditions below were used. As the second pickling step S7, which one of treatments shown below was carried out is shown in Table 2 (described later).

Temperature at which a slab piece was heated in the pretreatment step S1: 1230° C.

Time for which the slab piece was heated in the pretreatment step S1: 2 hours

Plate thickness after the hot rolling step S2: 4 mm

Pickle used in the first pickling step S4: a nitric hydrofluoric acid solution (aqueous solution containing 3% hydrofluoric acid and 10% nitric acid) at 60° C.

Plate thickness after the cold rolling step S5: 1.5 mm

Conditions under which pickling in the second pickling step S7 was carried out: (i) an electrolytic treatment in which electrolysis was carried out under a condition of 0.2 A/cm$^2$ to 0.3 A/cm$^2$ for 1 to 2 minutes in a state where a steel strip was immersed in a nitric acid solution (concentration of nitric acid: 150 g/L) at 50° C. to 70° C. (nitric acid electrolysis) or (ii) a treatment in which a steel strip was immersed in a mixed solution of nitric acid (concentration of nitric acid: 100 g/L) and hydrofluoric acid (15 g/L to 25 g/L) at 50° C. to 70° C. for 1 to 2 minutes (nitrohydrofluoric acid immersion).

TABLE 1

| | Steel type | C | Si | Mn | P | S | Ni | Cr | N | Nb | Mo | Cu | Al | Ti | Others |
|---|---|---|---|---|---|---|---|---|---|---|---|---|---|---|---|
| Inventive Example | A1 | 0.009 | 0.23 | 0.98 | 0.027 | 0.002 | 0.15 | 18.34 | 0.008 | 0.65 | 2.05 | 0.19 | 0.019 | — | |
| | A2 | 0.008 | 1 .12 | 1.06 | 0.027 | 0.001 | 0.12 | 13.88 | 0.010 | 0.39 | — | 0.13 | 0.033 | — | |
| | A3 | 0.006 | 0.25 | 0.22 | 0.026 | 0.001 | 0.29 | 17.05 | 0.008 | 0.55 | 0.05 | 1.33 | 0.034 | 0.150 | |
| | A4 | 0.007 | 0.56 | 0.20 | 0.028 | 0.001 | 0.12 | 18.54 | 0.018 | 0.44 | 0.05 | 0.45 | 0.023 | — | |
| | A5 | 0.012 | 0.43 | 0.33 | 0.031 | 0.001 | 0.17 | 22.09 | 0.01 1 | 0.20 | 1.04 | 0.23 | 0.069 | 0.200 | |
| | A6 | 0.008 | 0.38 | 0.88 | 0.025 | 0.001 | 0.08 | 17.12 | 0.009 | 0.47 | 1.99 | 1.52 | 0.021 | — | W: 1.3 |
| | A7 | 0.009 | 0.35 | 0.91 | 0.022 | 0.001 | 0.12 | 18.12 | 0.009 | 0.66 | 1.99 | 0.18 | 0.01 1 | — | La: 0.04<br>Ce: 0.01 |
| | A8 | 0.007 | 0.22 | 0.81 | 0.032 | 0.005 | 0.45 | 17.85 | 0.009 | 0.55 | 1.88 | 0.21 | 0.004 | 0.010 | B: 0.0012, Ta: 0.28 |
| | A9 | 0.008 | 0.34 | 0.54 | 0.031 | 0.003 | 0.23 | 18.34 | 0.009 | 0.45 | 1.95 | 0.45 | 0.021 | 0.140 | Zr: 0.21 |
| | A10 | 0.007 | 0.19 | 0.67 | 0.029 | 0.002 | 0.37 | 18.65 | 0.008 | 0.51 | 1.81 | 0.21 | 0.004 | 0.010 | Ga 0.15 |
| | A11 | 0.006 | 0.30 | 0.44 | 0.025 | 0.001 | 0.21 | 18.09 | 0.007 | 0.53 | 1.95 | 0.19 | 0.002 | 0.009 | Sb: 0.15, Sn: 0.06 |
| | A12 | 0.004 | 0.34 | 0.80 | 0.023 | 0.001 | 0.19 | 17.09 | 0.006 | 0.48 | 0.01 | 1.41 | 0.002 | 0.130 | Co: 0.19, Hf: 0.08 |
| | A13 | 0.005 | 0.91 | 0.39 | 0.022 | 0.001 | 0.19 | 13.19 | 0.006 | 0.49 | 0.01 | 0.15 | 0.022 | 0.010 | Ca: 0.0025, Mg: 0.0029 |
| Comparative Example | B1 | 0.009 | 0.08 | 0.88 | 0.031 | 0.001 | 0.1 1 | 14.02 | 0.008 | 0.41 | — | 0.13 | 0.023 | — | |
| | B2 | 0.007 | 0.42 | 0.33 | 0.028 | 0.002 | 0.23 | 9.81 | 0.009 | 0.43 | — | 0.11 | 0.021 | 0.150 | |
| | B3 | 0.008 | 0.75 | 0.31 | 0.027 | 0.001 | 0.12 | 12.10 | 0.010 | 0.01 | — | 0.01 | 0.010 | 0.220 | |
| | B4 | 0.018 | 0.23 | 0.33 | 0.023 | 0.001 | 0.1 1 | 17.45 | 0.009 | — | — | 0.02 | 0.012 | 0.360 | |

Examples of the present invention are described below. In Examples, the composition of each stainless steel shown in Table 1 is shown by % by weight. Further, a remainder other than the components shown in Table 1 is Fe or a small amount of an impurity which is inevitably contained. Underlines shown in Table 1 indicate that components contained in the stainless steel of Comparative Examples of the present invention fall outside the scope of the present invention.

As shown in Table 1, the ferritic stainless steel manufactured within the scope of the present invention was referred to as Inventive Example Steel Types A1 to A13. The ferritic stainless steel manufactured under conditions falling outside the scope of the present invention was referred to as Comparative Example Steel Types B1 to B4.

Table 2 shows results of carrying out tests so as to evaluate red scale resistance and high-temperature strength of Inventive Example Steel Types A1 to A13 and Comparative Example Steel Types B1 to B4.

TABLE 2

| Steel type No. | | S7 Pickling step: Nitric acid electrolysis | S7 Pickling step: Hydrofluoric acid immersion | S8 Pickling step Nitric acid 80 to 120 g/L at 60 ± 10° C. Immersion time (sec) | Integral concentration of Cr + Si in passive film (6 nm) >240 (%) | 600° C. × 100 h weight gain due to oxidation ≤0.3 (mg/cm2) | 800° C., 0.2% proof stress ≥20 (MPa) | Overall evaluation | |
|---|---|---|---|---|---|---|---|---|---|
| A1 | 1 | ○ | No | 40 | 241.8 | 0.01 | 40 | ○ | Inventive Example |
| | 2 | ○ | No | 60 | 244.6 | 0.01 | 40 | ○ | |
| | 3 | ○ | No | 80 | 243 | 0.01 | 40 | ○ | |
| | 4 | ○ | No | 120 | 246.4 | 0.01 | 41 | ○ | |
| A2 | 5 | ○ | No | 40 | 248.4 | 0.01 | 24 | ○ | |
| | 6 | ○ | No | 60 | 255.2 | 0.01 | 25 | ○ | |
| | 7 | ○ | No | 80 | 252.4 | 0.01 | 24 | ○ | |
| | 8 | ○ | No | 120 | 257 | 0.01 | 24 | ○ | |
| A3 | 9 | ○ | No | 60 | 243.6 | 0.01 | 43 | ○ | |
| | 10 | ○ | No | 80 | 242.4 | 0.02 | 42 | ○ | |
| | 11 | ○ | No | 120 | 244.2 | 0.01 | 42 | ○ | |
| A4 | 12 | ○ | No | 40 | 243.8 | 0.01 | 25 | ○ | |
| | 13 | ○ | No | 60 | 245.8 | 0.01 | 25 | ○ | |
| | 14 | ○ | No | 80 | 245 | 0.01 | 25 | ○ | |
| | 15 | ○ | No | 120 | 247 | 0.01 | 26 | ○ | |
| A5 | 16 | ○ | No | 40 | 257.4 | 0.01 | 42 | ○ | |
| | 17 | ○ | No | 60 | 256.6 | 0.01 | 42 | ○ | |
| | 18 | ○ | No | 80 | 259.6 | 0.01 | 41 | ○ | |
| | 19 | ○ | No | 120 | 261 | 0.01 | 43 | ○ | |
| A6 | 20 | ○ | No | 40 | 253.6 | 0.01 | 45 | ○ | |
| | 21 | ○ | No | 60 | 253 | 0.01 | 45 | ○ | |
| | 22 | ○ | No | 80 | 253 | 0.01 | 45 | ○ | |
| | 23 | ○ | No | 120 | 255.6 | 0.01 | 46 | ○ | |
| A7 | 24 | ○ | No | 40 | 246.2 | 0.01 | 24 | ○ | |
| | 25 | ○ | No | 60 | 245.8 | 0.01 | 24 | ○ | |
| | 26 | ○ | No | 80 | 244.4 | 0.01 | 24 | ○ | |
| | 27 | ○ | No | 120 | 246.2 | 0.01 | 24 | ○ | |
| A8 | 28 | No | ○ | 40 | 247.8 | 0.01 | 38 | ○ | |
| | 29 | No | ○ | 60 | 247.1 | 0.01 | 39 | ○ | |
| | 30 | No | ○ | 80 | 245.7 | 0.01 | 38 | ○ | |
| | 31 | No | ○ | 120 | 246.4 | 0.01 | 38 | ○ | |
| A9 | 32 | No | ○ | 40 | 246.3 | 0.01 | 40 | ○ | |
| | 33 | No | ○ | 60 | 248.5 | 0.01 | 40 | ○ | |
| | 34 | No | ○ | 80 | 247.7 | 0.01 | 41 | ○ | |
| | 35 | No | ○ | 120 | 247.6 | 0.01 | 41 | ○ | |
| A10 | 36 | No | ○ | 40 | 243.4 | 0.01 | 37 | ○ | |
| | 37 | No | ○ | 60 | 245.3 | 0.01 | 38 | ○ | |
| | 38 | No | ○ | 80 | 243.4 | 0.01 | 38 | ○ | |
| | 39 | No | ○ | 120 | 242.1 | 0.01 | 38 | ○ | |
| A11 | 40 | No | ○ | 40 | 242.3 | 0.01 | 40 | ○ | |
| | 41 | No | ○ | 60 | 245.3 | 0.01 | 40 | ○ | |
| | 42 | No | ○ | 80 | 243.8 | 0.01 | 40 | ○ | |
| | 43 | No | ○ | 120 | 243.9 | 0.01 | 41 | ○ | |
| A12 | 44 | No | ○ | 40 | 243.2 | 0.01 | 41 | ○ | |
| | 45 | No | ○ | 60 | 240.3 | 0.01 | 40 | ○ | |
| | 46 | No | ○ | 80 | 241 .3 | 0.01 | 40 | ○ | |
| | 47 | No | ○ | 120 | 242.2 | 0.01 | 41 | ○ | |
| A13 | 48 | No | ○ | 40 | 248.1 | 0.01 | 25 | ○ | |
| | 49 | No | ○ | 60 | 250.1 | 0.01 | 25 | ○ | |
| | 50 | No | ○ | 80 | 249.8 | 0.01 | 26 | ○ | |
| | 51 | No | ○ | 120 | 248.5 | 0.01 | 25 | ○ | |
| A1 | 1 | ○ | No | 20 | 202.6 | 4.5 | 40 | x | Comparative Example |
| | 2 | ○ | No | 30 | 209 | 4.3 | 40 | x | |
| | 3 | ○ | No | 140 | 238.4 | 2.3 | 40 | x | |
| | 4 | ○ | No | 180 | 237 | 2.2 | 40 | x | |
| A2 | 5 | ○ | No | 0 | 202.1 | 4.2 | 25 | x | |
| | 6 | ○ | No | 20 | 224.2 | 4.5 | 25 | x | |
| | 7 | ○ | No | 30 | 229 | 4.1 | 26 | x | |
| | 8 | ○ | No | 140 | 238.2 | 2.1 | 25 | x | |
| | 9 | ○ | No | 180 | 238.6 | 2.3 | 26 | x | |
| A3 | 10 | ○ | No | 0 | 219.8 | 4.5 | 43 | x | |
| | 11 | ○ | No | 20 | 231.4 | 4.9 | 42 | x | |
| | 12 | ○ | No | 30 | 232.8 | 4.3 | 42 | x | |
| | 13 | ○ | No | 40 | 232.2 | 4.1 | 43 | x | |
| A4 | 14 | ○ | No | 20 | 226.8 | 3.8 | 24 | x | |
| | 15 | ○ | No | 30 | 226.8 | 3.7 | 24 | x | |
| A5 | 16 | ○ | No | 20 | 239.6 | 0.4 | 43 | x | |
| | 17 | ○ | No | 30 | 238.4 | 0.35 | 42 | x | |

TABLE 2-continued

| Steel type No. | | S7 Pickling step: Nitric acid electrolysis | S7 Pickling step: Hydrofluoric acid immersion | S8 Pickling step Nitric acid 80 to 120 g/L at 60 ± 10° C. Immersion time (sec) | Integral concentration of Cr + Si in passive film (6 nm) >240 (%) | 600° C. × 100 h weight gain due to oxidation ≤0.3 (mg/cm2) | 800° C., 0.2% proof stress ≥20 (MPa) | Overall evaluation |
|---|---|---|---|---|---|---|---|---|
| A6 | 18 | ○ | No | 20 | 232.6 | 2.8 | 46 | x |
| | 19 | ○ | No | 30 | 235 | 3.2 | 46 | x |
| | 20 | ○ | No | 140 | 238.2 | 2.1 | 25 | x |
| | 21 | ○ | No | 180 | 234.2 | 2.3 | 26 | x |
| A7 | 22 | No | No | 180 | 209.1 | 3.2 | 33 | x |
| A8 | 23 | No | ○ | 30 | 218.9 | 2.3 | 35 | x |
| B1 | 24 | ○ | No | 20 | 237.4 | 2.5 | 24 | x |
| | 25 | ○ | No | 30 | 234.8 | 2.6 | 24 | x |
| | 26 | ○ | No | 140 | 238.4 | 2.1 | 25 | x |
| | 27 | ○ | No | 180 | 235.2 | 2.3 | 26 | x |
| B2 | 28 | ○ | No | 20 | 219.6 | 5.1 | 24 | x |
| | 29 | ○ | No | 30 | 220.2 | 5.1 | 23 | x |
| B3 | 30 | ○ | No | 20 | 227 | 5.3 | 18 | x |
| | 31 | ○ | No | 30 | 231.2 | 4.9 | 17 | x |
| B4 | 32 | ○ | No | 20 | 234.2 | 3.4 | 19 | x |
| | 33 | ○ | No | 30 | 236.8 | 3.5 | 19 | x |
| | 34 | ○ | No | 60 | 240.6 | 0.02 | 19 | x |

Inventive Examples Nos. 1 to 51 shown in Table 2 are those that were obtained as a result of subjecting Inventive Example Steel Types A1 to A13 to the surface activation treatment of the present invention or a pickling treatment which fell outside the scope of the surface activation treatment of the present invention. Specifically, each of Inventive Examples Nos. 1, 5, 12, 16, 20, 24, 20, 24, 28, 32, 36, 40, 44, and 48 was obtained as a result of carrying out the pickling treatment which fell outside the scope of the surface activation treatment of the present invention, because a time for which immersion in the nitric acid solution (80 g/L to 120 g/L) at 60±10° C. was carried out was 40 seconds. The other Inventive Examples are those that were obtained as a result of carrying out the surface activation treatment of the present invention.

Comparative Examples Nos. 1 to 34 are those that were obtained as a result of subjecting Inventive Example Steel Types A1 to A8 and Comparative Example Steel Types B1 to B4 to the pickling treatment which fell outside the scope of the surface activation treatment of the present invention. Specifically, although it is a shared point that the nitric acid solution (80 g/L to 120 g/L) at 60±10° C. was used, the time for which the immersion was carried out fell outside the scope of the surface activation treatment of the present invention. Comparative Example No. 22 is one that was obtained as a result of subjecting Inventive Example Steel Type A7 to the surface activation treatment of the present invention, without subjecting it to the second pickling step S7. Comparative Example No. 34 is one that was obtained as a result of subjecting Comparative Example Steel Type B4 to the surface activation treatment of the present invention.

First, in regard to each of Inventive Examples Nos. 1 to 51 and Comparative Examples Nos. 1 to 34, Cr(O) and Si(O) in a passive film were measured and calculated as detailed below.

<Measurement of Cr(O) and Si(O) in Passive Film>

In order to evaluate the degree of concentration of Cr and Si in the passive film, Cr(O) and Si(O) of a steel sheet manufactured by the foregoing manufacturing method were calculated as has been described, and a value of Cr(O)+Si(O) was determined. Results are shown in a column "Integral concentration of Cr+Si in passive film (6 nm)" in Table 2. In a case where Cr(O) and Si(O) satisfy the foregoing Expression (1), the steel sheet falls within the scope of the present invention.

As shown in Table 2, all of Inventive Examples which were obtained as a result of subjecting Inventive Examples Steel Types A1 to A13 to the surface activation treatment of the present invention (out of Inventive Examples Nos. 1 to 51, Inventive Examples other than Inventive Examples Nos. 1, 5, 12, 16, 20, 24, 20, 24, 28, 32, 36, 40, 44, and 48) satisfied the foregoing Expression (1).

Figure 2:
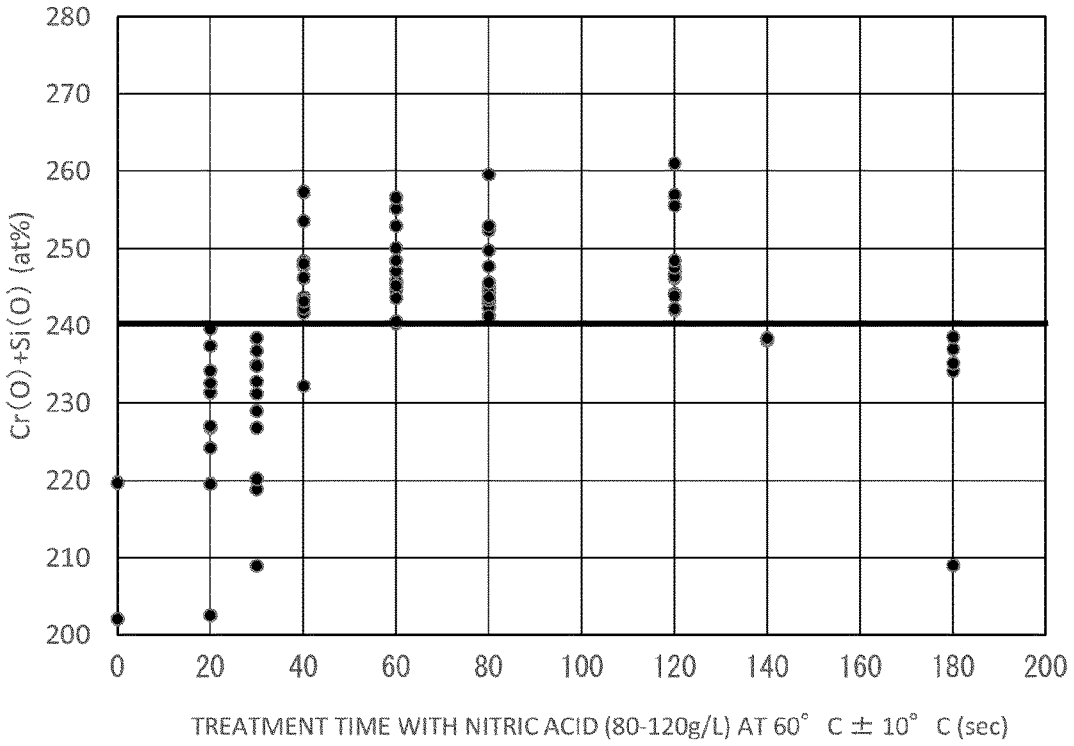
FIG. 2 is a graph showing, in regard to each of Examples, a relationship between (i) a time for which a treatment was carried out with use of a nitric acid solution (80 g/L to 120 g/L) at 60±10° C. and (ii) Cr(O)+Si(O).

FIG. 2 is a graph showing, in regard to each of Examples, a relationship between (i) the time for which the treatment was carried out with use of the nitric acid solution (80 g/L to 120 g/L) at 60±10° C. and (ii) Cr(O)+Si(O). As is clear from the graph shown in FIG. 2, it was demonstrated that Cr(O)+Si(O)≥240 in a case where the time for which the treatment was carried out was 60 seconds to 120 seconds, i.e., the surface activation treatment which fell within the scope of the present invention was carried out.

<Red Scale Resistance Evaluation Test>

A red scale resistance evaluation test was carried out with respect to Inventive Examples Nos. 1 to 51 and Comparative Examples Nos. 1 to 34 shown in Table 2. Results of the test are shown in Table 2.

The red scale resistance evaluation test was carried out in accordance with JIS Z 2281 (Test method for continuous oxidation test at elevated temperatures for metallic materials), and evaluation was carried out with use of a weight gain due to oxidation. As a criterion for the evaluation, a weight gain due to oxidation by not more than 0.3 mg/cm$^2$ was set as an acceptable range.

First, a test piece measuring 20 mm×25 mm was cut out from the steel sheet manufactured by the foregoing manufacturing method. The test piece was continuously heated at 600° C. for 100 hours in an atmospheric air environment having a water vapor concentration of 10% by volume. A weight gain due to oxidation was calculated from a change in weight before and after the test.

As shown in Table 2, all of Inventive Examples which were obtained as a result of subjecting Inventive Examples Steel Types A1 to A13 to the surface activation treatment of the present invention (out of Inventive Examples Nos. 1 to 51, Inventive Examples other than Inventive Examples Nos. 1, 5, 12, 16, 20, 24, 20, 24, 28, 32, 36, 40, 44, and 48) satisfied the above criterion.

Figure 3:
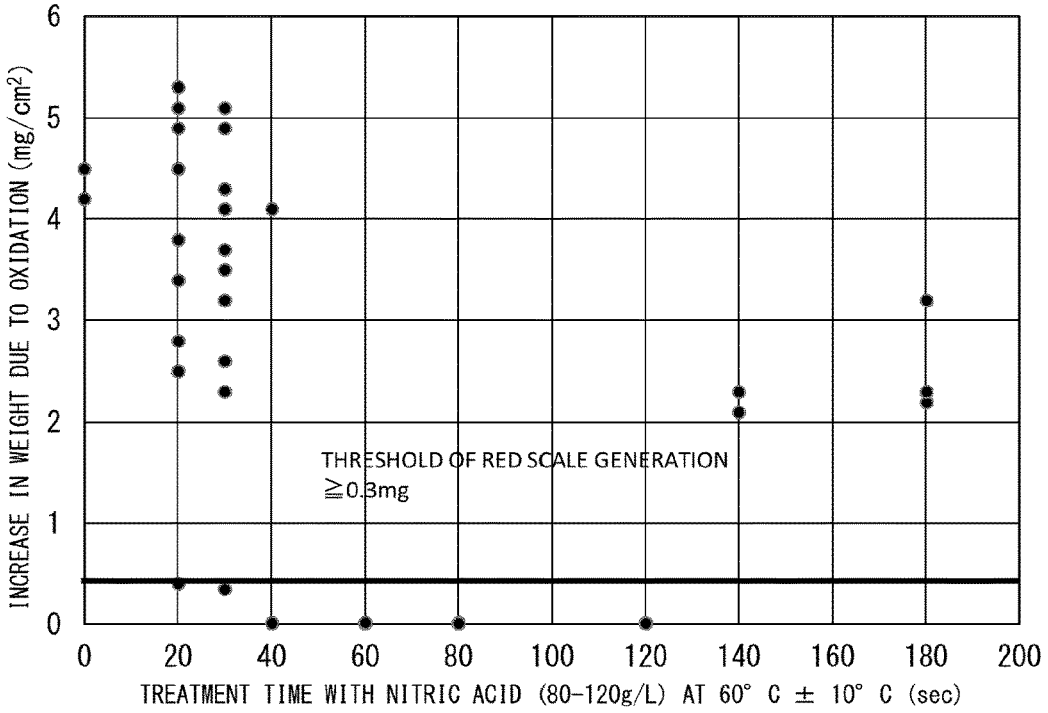
FIG. 3 is a graph showing, in regard to each of Examples, a relationship between (i) the time for which the treatment was carried out with use of the nitric acid solution (80 g/L to 120 g/L) at 60±10° C. and (ii) a weight gain due to oxidation.

FIG. 3 is a graph showing, in regard to each of Examples, a relationship between (i) the time for which the treatment was carried out with use of the nitric acid solution (80 g/L to 120 g/L) at 60±10° C. and (ii) the weight gain due to oxidation. As is clear from the graph shown in FIG. 3, it was demonstrated that all weight gains due to oxidation satisfied the range of not more than 0.3 mg/cm$^2$, in a case where the time for which the treatment was carried out was 60 seconds to 120 seconds, i.e., the surface activation treatment which fell within the scope of the present invention was carried out.

Figure 4:
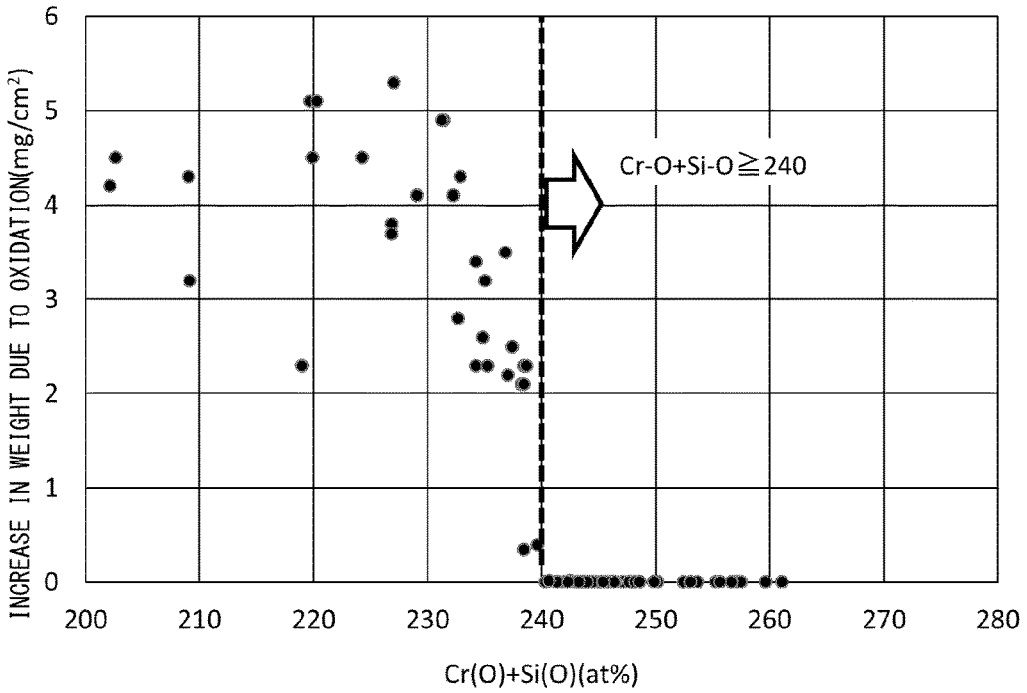
FIG. 4 is a graph showing, in regard to each of Examples, a relationship between (i) Cr(O)+Si(O) and (ii) the weight gain due to oxidation.

FIG. 4 is a graph showing, in regard to each of Examples, a relationship between (i) Cr(O)+Si(O) and (ii) the weight gain due to oxidation. As is clear from the graph shown in FIG. 4, it was demonstrated that all weight gains due to oxidation satisfied the range of not more than 0.3 mg/cm$^2$, in a case where the expression that Cr(O)+Si(O)≥240 was satisfied.

<High-Temperature Strength Evaluation Test>

A high-temperature strength evaluation test was carried out with respect to Inventive Examples Nos. 1 to 51 and Comparative Examples Nos. 1 to 34 shown in Table 2. Results of the test are shown in Table 2.

The high-temperature strength evaluation test was carried out with use of a test piece which complied with JIS Z 2241 (Metallic materials—Tensile testing—Method of test at room temperature) by a tensile method which complied with JIS G 0567 (Method of elevated temperature tensile test for steels and heat-resisting alloys).

The plate thickness of the test piece was 2 mm, the plate width of the test piece was 12.5 mm, and the gage length of the test piece was 50 mm. An evaluation was made with respect to a portion between gauge marks with use of a 0.2% proof stress value under the conditions that a strain rate until proof stress was reached was 0.3%/min and tensile strength until the proof stress was reached was 3 mm/min. As a criterion for the evaluation, 0.2% proof stress of not less than 20 MPa was set as an acceptable range.

As shown in Table 2, all of Invention Examples Nos. 1 to 51 satisfied the above criterion. On the other hand, Comparative Examples Nos. 30-34 did not satisfy the above criterion.

Based on the above test results, overall evaluations were made in which (i) a case where both of the criteria of the red scale resistance evaluation test and high-temperature strength evaluation test were satisfied was evaluated as acceptable (o) and (ii) a case where one or both of the criteria were not satisfied was evaluated as unacceptable (x). Results of the overall evaluations are shown in Table 2.

From the overall evaluations shown in Table 2, the following were demonstrated.

All of Examples which were obtained from Inventive Example Steel Types A1 to A13 and which satisfied the foregoing Expression (1) were acceptable as the overall evaluations.

Examples which were obtained from Inventive Example Steel Types A1 to A13 but which did not satisfy the foregoing Expression (1) (Comparative Example Nos. 1 to 23) were unacceptable as the overall evaluations.

All of Examples which were obtained as a result of subjecting Inventive Example Steel Types A1 to A7 to the surface activation treatment of the present invention satisfied the foregoing Expression (1), and were acceptable as the overall evaluations.

Example which was obtained as a result of subjecting Comparative Example Steel Type B4 to the surface activation treatment of the present invention (Comparative Example No. 34) satisfied the foregoing Expression (1), but was unacceptable as the overall evaluation.

All of Examples which were obtained as a result of subjecting Inventive Example Steel Types A1 to A13 to the second pickling step S7, in which the foregoing nitric acid electrolysis or hydrofluoric acid immersion was carried out, and then to the surface activation treatment step S8 satisfied the foregoing Expression (1), and were acceptable as the overall evaluations.

Examples which were obtained from Inventive Example Steel Types A1 to A13 but which were obtained as a result of subjecting them only to the second pickling step S7 without subjecting them to the surface activation treatment step S8 (Comparative Examples Nos. 5 and 10) did not satisfy the foregoing Expression (1), and were unacceptable as the overall evaluations.

Examples which were obtained from Inventive Example Steel Types A1 to A13 but which were obtained as a result of subjecting them only to the surface activation treatment step S8 without subjecting them to the second pickling step S7 (Comparative Example No. 22) did not satisfy the foregoing Expression (1), and were unacceptable as the overall evaluation.

Aspects of the present invention can also be expressed as follows:

Ferritic stainless steel in accordance with an aspect of the present invention is ferritic stainless steel containing not more than 0.025% by mass of C, not less than 0.05% by mass and not more than 3.0% by mass of Si, not less than 0.05% by mass and not more than 2.0% by mass of Mn, not more than 0.04% by mass of P, not more than 0.03% by mass of S, not more than 0.5% by mass of Ni, not less than 10.5% by mass and not more than 25.0% by mass of Cr, not more than 0.025% by mass of N, not less than 0.05% by mass and not more than 1.0% by mass of Nb, not more than 3.0% by mass of Mo, not more than 1.8% by mass of Cu, not more than 0.2% by mass of Al, and not more than 0.5% by mass of Ti and containing iron and an inevitable impurity as a remainder, when spectra are measured, by XPS analysis, at a surface of the ferritic stainless steel and at depths of from 0.5 nm to 6 nm from the surface in increments of 0.5 nm, the ferritic stainless steel satisfying the following Expression (1):

$$Cr(O)+Si(O)\geq 240 \ldots \quad (1)$$

where (i) Cr(O) represents a value obtained by calculating, for each measurement depth in terms of an atomic percent concentration with use of each of the spectra, a proportion of the total number of atoms of Cr which is present as oxide or hydroxide to the total number of atoms of Fe, Cr, Ti, Nb, Mo, and Si each of which is present as a simple substance, oxide, or hydroxide and integrating all calculated atomic percent concentrations, and (ii) Si(O) represents a value obtained by calculating, for each measurement depth in terms of an atomic percent concentration with use of each of the spectra, a proportion of the number of atoms of Si which is present as oxide to the total number of atoms of Fe, Cr, Ti, Nb, Mo, and Si each of which is present as a simple substance, oxide, or hydroxide and integrating all calculated atomic percent concentrations.

According to the above configuration, it is possible to realize ferritic stainless steel which has excellent high-temperature strength and excellent red scale resistance.

The ferritic stainless steel in accordance with an aspect of the present invention may further contain one or more of not more than 2.5% by mass of W, not more than 0.1% by mass of La, not more than 0.05% by mass of Ce, not more than 0.01% by mass of B, not less than 0.0002% by mass and not more than 0.0030% by mass of Ca, not less than 0.001% by mass and not more than 0.5% by mass of Hf, not less than 0.01% by mass and not more than 0.40% by mass of Zr, not less than 0.005% by mass and not more than 0.50% by mass of Sb, not less than 0.01% by mass and not more than 0.30% by mass of Co, not less than 0.001% by mass and not more than 1.0% by mass of Ta, not less than 0.002% by mass and not more than 1.0% by mass of Sn, not less than 0.0002% by mass and not more than 0.30% by mass of Ga, not less than 0.001% by mass and not more than 0.20% by mass of a rare earth element, and not less than 0.0003% by mass and not more than 0.0030% by mass of Mg.

According to the above configuration, it is possible to further enhance the red scale resistance and scale peeling resistance.

A method for manufacturing ferritic stainless steel in accordance with an aspect of the present invention is a method for manufacturing ferritic stainless steel which contains not more than 0.025% by mass of C, not less than 0.05% by mass and not more than 3.0% by mass of Si, not less than 0.05% by mass and not more than 2.0% by mass of Mn, not more than 0.04% by mass of P, not more than 0.003% 0.03% by mass of S, not more than 0.5% by mass of Ni, not less than 10.5% by mass and not more than 25.0% by mass of Cr, not more than 0.025% by mass of N, not less than 0.05% by mass and not more than 1.0% by mass of Nb, not more than 3.0% by mass of Mo, not more than 1.8% by mass of Cu, not more than 0.2% by mass of Al, and not more than 0.5% by mass of Ti and which contains iron and an inevitable impurity as a remainder, the method including a surface activation treatment step of immersing a steel strip, which has been subjected to a descaling treatment, in 80 g/L to 120 g/L of a nitric acid solution at not lower than 50° C. and not higher than 70° C. for not shorter than 60 seconds and not longer than 120 seconds.

According to the above configuration, it is possible to manufacture ferritic stainless steel which has excellent high-temperature strength and excellent red scale resistance, without causing an increase in manufacturing costs.

The method in accordance with an aspect of the present invention may be arranged such that the ferritic stainless steel further contains not more than 2.5% by mass of W, not more than 0.1% by mass of La, and not more than 0.05% by mass of Ce.

According to the above configuration, it is possible to manufacture ferritic stainless steel which has further enhanced red scale resistance and further enhanced scale peeling resistance and accordingly has excellent high-temperature strength and excellent red scale resistance, without causing an increase in manufacturing costs.

(Supplementary Note)

The present invention is not limited to the embodiments, but can be altered by a skilled person in the art within the scope of the claims. The present invention also encompasses, in its technical scope, any embodiment derived by combining technical means disclosed in differing embodiments.

The invention claimed is:

1. Ferritic stainless steel comprising:

not more than 0.025% by mass of C, not less than 0.05% by mass and not more than 3.0% by mass of Si, not less than 0.05% by mass and not more than 2.0% by mass of Mn, not more than 0.04% by mass of P, not more than 0.03% by mass of S, not more than 0.5% by mass of Ni, not less than 10.5% by mass and not more than 25.0% by mass of Cr, not more than 0.025% by mass of N, not less than 0.39% by mass and not more than 1.0% by mass of Nb, not more than 3.0% by mass of Mo, not more than 0.13% by mass of Cu, not more than 0.2% by mass of Al, not more than 0.5% by mass of Ti, and iron and an inevitable impurity as a remainder, when spectra are measured by XPS analysis at a surface of said ferritic stainless steel and at depths of from 0.5 nm to 6 nm from the surface in increments of 0.5 nm, said ferritic stainless steel satisfying the following Expression (1):

$$240 \leq Cr(O)+Si(O) \leq 261 \quad (1)$$

where (i) Cr(O) represents a value obtained by calculating, for each measurement depth in terms of an atomic percent concentration with use of each of the spectra, a proportion of the total number of atoms of Cr which is present as oxide or hydroxide to the total number of atoms of Fe, Cr, Ti, Nb, Mo, and Si each of which is present as a simple substance, oxide, or hydroxide and integrating all calculated atomic percent concentrations, and (ii) Si(O) represents a value obtained by calculating, for each measurement depth in terms of an atomic percent concentration with use of each of the spectra, a proportion of the number of atoms of Si which is present as oxide to the total number of atoms of Fe, Cr, Ti, Nb, Mo, and Si each of which is present as a simple substance, oxide, or hydroxide and integrating all calculated atomic percent concentrations.

2. The ferritic stainless steel as set forth in claim 1, further comprising one or more of:

not more than 2.5% by mass of W, not more than 0.01% by mass of B, not less than 0.0002% by mass and not more than 0.0030% by mass of Ca, not less than 0.001% by mass and not more than 0.5% by mass of Hf, not less than 0.01% by mass and not more than 0.40% by mass of Zr, not less than 0.005% by mass and not more than 0.50% by mass of Sb, not less than 0.01% by mass and not more than 0.30% by mass of Co, not less than 0.001% by mass and not more than 1.0% by mass of Ta, not less than 0.002% by mass and not more than 1.0% by mass of Sn, not less than 0.0002% by mass and not more than 0.30% by mass of Ga, not less than 0.001% by mass and not more than 0.20% by mass of a rare earth element, and not less than 0.0003% by mass and not more than 0.0030% by mass of Mg.

3. The ferritic stainless steel as set forth in claim 2, further comprising one or more of: not more than 0.1% by mass of La, and not more than 0.05% by mass of Ce.

* * * * *